US005711502A

United States Patent [19]

Emalfarb et al.

[11] Patent Number: 5,711,502

[45] Date of Patent: Jan. 27, 1998

[54] ARTICLE HANGER

[76] Inventors: Seymour Emalfarb, 1585 Saunders Rd., River Woods, Ill.; Bradley S. Emalfarb, 26529 N. Hwy. 83, Mundelein, Ill. 60060

[21] Appl. No.: 517,574

[22] Filed: Aug. 21, 1995

[51] Int. Cl.[6] ..... A47H 1/16

[52] U.S. Cl. ..... 248/302

[58] Field of Search ..... 248/278, 302, 248/303, 304, 318; 47/31, 39 C, 39 P, 40, 67 R, 68

[56] References Cited

U.S. PATENT DOCUMENTS

| | | | |
|---|---|---|---|
| 1,580,847 | 4/1926 | Moineau . | |
| 1,957,353 | 5/1934 | Piersall . | |
| 2,294,151 | 8/1942 | Wooten, Jr. et al. . | |
| 2,318,930 | 5/1943 | Dietrich . | |
| 2,764,384 | 9/1956 | Kirsch . | |
| 2,807,513 | 9/1957 | Stein . | |
| 3,013,759 | 12/1961 | Smith . | |
| 3,219,302 | 11/1965 | Smith . | |
| 3,490,726 | 1/1970 | Mills . | |
| 3,511,461 | 5/1970 | Clark . | |
| 3,532,318 | 10/1970 | Lloyd . | |
| 4,248,352 | 2/1981 | White . | |
| 4,379,582 | 4/1983 | Cullinane . | |
| 4,418,496 | 12/1983 | Koistinen . | |
| 4,524,542 | 6/1985 | Elliot | 47/68 X |
| 5,181,621 | 1/1993 | Plaehn . | |
| 5,368,267 | 11/1994 | Howard | 248/27.8 X |
| 5,390,443 | 2/1995 | Emalfarb et al. . | |

*Primary Examiner*—Ramon O. Ramirez
*Attorney, Agent, or Firm*—Wood, Phillips, VanSanten, Clark & Mortimer

[57] ABSTRACT

An article hanger having a frame defining a support for an article, with the support facing upwardly with the article hanger in a display state/orientation. First structure is provided for connecting the frame to an upright support. The first structure includes a bracket and second structure cooperating between the bracket and frame for selectively placing the frame and bracket in a) a first relative position wherein the frame and bracket cooperatively define a U shape with a first width for straddling an upright support to maintain the article hanger in the display orientation and b) a second relative position wherein the frame and bracket cooperatively define a U shape with a second width for straddling an upright support to maintain the article hanger in the display orientation. The first and second widths are different.

19 Claims, 4 Drawing Sheets

FIG. 3
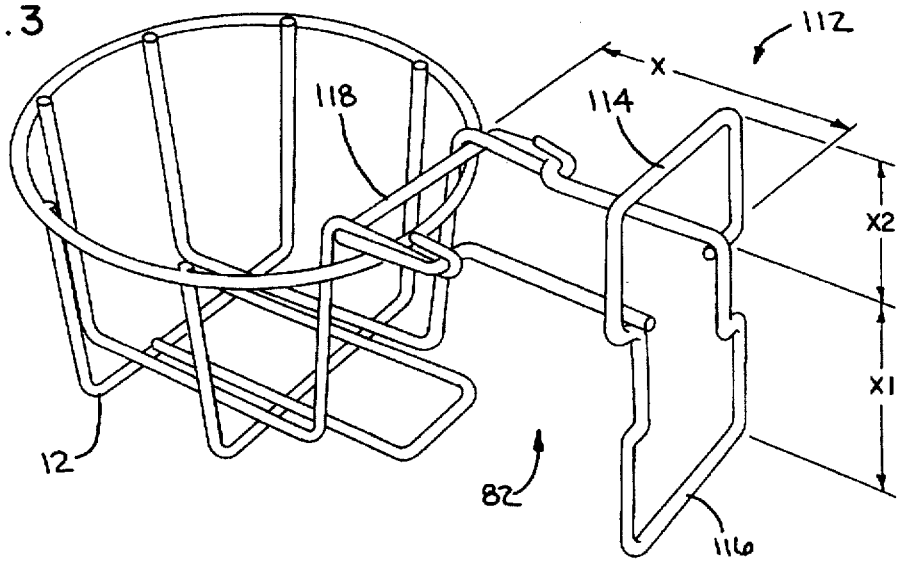
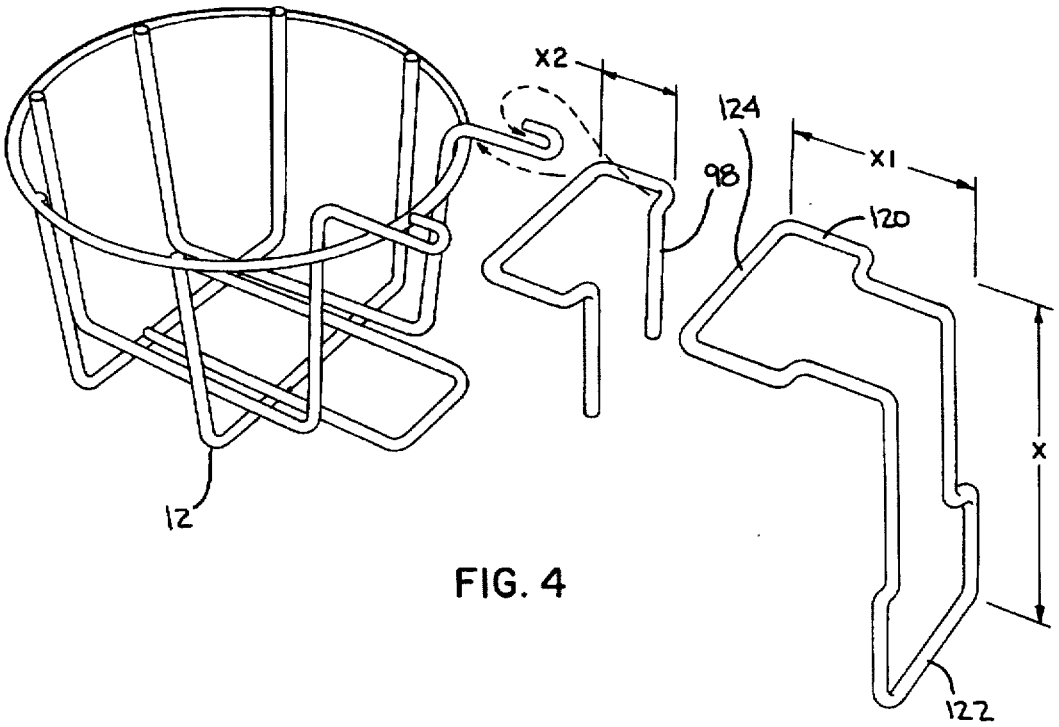
FIG. 4

ARTICLE HANGER

BACKGROUND OF THE INVENTION

1. Field of the Invention

This invention relates to hangers for supporting articles, such as pots for foliage and, more particularly, to a hanger of the type that can be suspended from an upright support, such as a post or rail.

2. Background Art

There has been a growing trend towards decorating around private homes and commercial buildings using hanging plants. This concept is particularly popular around decks. Plant hangers for this purpose come in a variety of different styles. Some hangers are merely flexible lines which cradle a pot with a plant therein. Others use receptacles having brackets that straddle, and are supported on, an upper edge of a support, such as a post, or a horizontally extending rail.

One commercially successful hanger design of the latter type is shown in U.S. Pat. No. 5,390,443, invented by the inventors herein. In that patent, various configurations of receptacle are shown defined by formed and welded, plastic coated wire. Each of these hangers has a frame defining the receptacle and an integrally formed extension thereof, defining in conjunction with the frame an inverted, U-shaped seat, with one leg and the base of the "U" bounded by the frame extension, and the other leg of the "U" bounded by the frame.

With the above type of hanger in a display state, the base of the "U" bears upon an upwardly facing surface of the support, with the legs of the "U" bearing one each against oppositely facing vertical surfaces on the support.

For the above type of hanger to situate consistently in the display state, the width of the "U", i.e. the spacing between the legs of the "U", must be selected to correspond to the width of the support surface. This type of hanger is most commonly supported upon the top rail of a deck seat or fence. This top rail is typically defined by 2×4 or 2×6 lumber, with the longer dimension of this rail extending either vertically or horizontally. Consequently, designers of this type of hanger normally configure the hanger to accommodate nominal 2, 4 and 6 inch members.

With a fixed configuration hanger, manufacturers and purveyors must provide three different products, requiring three different packages and three different SKU numbers. This complicates the manufacturing process by requiring potentially three diversions on an assembly line. From a sales standpoint, the purveyor is required to project sales volume for each different type of hanger and to separately store and display all three types. The result is that an excess amount of valuable storage and display space may be taken up.

Oft times, to the consumer, it is unclear that this type of hanger does not have a universal construction. The assignee herein has discovered, through its customers, that a large number of returns are made resulting from purchase of the wrong "size" hanger. This is a significant inconvenience to the purveyor, requiring repackaging and restocking of returned goods.

Even if the consumer is aware that the hangers come in different sizes, he/she may not decide upon where the hanger will actually be placed until it is taken home and tested. That is, once the consumer takes the hanger home, he/she may decide, after experimentation, that the hanger looks better suspended at a location where a two inch support surface is available as opposed to one where a four inch support surface is available. This results in additional returns and an inconvenience to both the consumer and the purveyor of the hangers.

A still further problem with a fixed configuration hanger is that while the extension on the frame, which facilitates its hanging, may be only a short length of wire, it nonetheless adds considerably to the required packaging size. With a relatively narrow hanger receptacle, the six inch version of the hanger may require a box approximately two times the volume of the box required to contain the receptacle alone. This is obviously an undesirable feature to both the manufacture and the purveyor. Additionally, the consumer that removes and stores the hanger may find this size obtrusive.

Product size is particularly a problem with long range/overseas shipments. The packages with the hangers therein, while light in weight, may be costly to ship because of their size. The hangers which are relatively lost cost items, do not lend themselves to a significant markup to absorb shipping charges.

SUMMARY OF THE INVENTION

In one form of the invention, an article hanger is provided having a frame defining a support for an article, with the support facing upwardly with the article hanger in a display state/orientation. First structure is provided for connecting the frame to an upright support. The first structure includes a bracket and second structure cooperating between the bracket and frame for selectively placing the frame and bracket in a) a first relative position wherein the frame and bracket cooperatively define a U shape with a first width for straddling an upright support to maintain the article hanger in the display orientation and b) a second relative position wherein the frame and bracket cooperatively define a U shape with a second width for straddling an upright support to maintain the article hanger in the display orientation. The first and second widths are different.

In one form, the frame has a cup-shaped configuration.

In one form, the first structure allows the frame and bracket to be maintained in each of the first and second relative positions without the use of separate fasteners.

The bracket may be defined by a single, formed piece of wire.

In one form, the wire has a U shape with first and second legs, each having a free end, with the first structure including the free ends of the first and second legs which mesh/intertwine with the frame.

In one form, the bracket has a first portion, that upon being cut from the remainder of the bracket, defines a sub-bracket. There is structure cooperating between the sub-bracket and frame for selectively placing the frame and sub-bracket in a relative position wherein the frame and sub-bracket cooperatively define a U shape with a third width for straddling an upright support to maintain the article hanger in the display orientation. The third width is different than both the first and second widths.

The first structure may cooperate between the bracket and frame for selectively placing the frame and bracket in a third relative position wherein the frame and bracket cooperatively define a U shape with a third width for straddling an upright support to maintain the article hanger in the display orientation. The third width is different than the first and second widths.

In one form, the second structure cooperating between the bracket and frame includes a post projecting in cantilever fashion from one of the frame and bracket and a socket for receiving the post on the other of the frame and bracket.

The bracket may have an L shape with first and second legs, each having a length, with the first and second legs having different lengths. The second structure cooperating between the bracket and frame may be a post projecting in cantilever fashion from the frame and a socket for receiving the post on each of the first and second legs. With the post received in the socket on the first leg, the frame and bracket are in the first relative position, and with the post received in the socket on the second leg, the frame and bracket are in the second relative position.

The invention further contemplates a combination including a frame defining a support for an article, which support faces upwardly with the article hanger in a display orientation. The combination further includes a first bracket with there being first structure cooperating between the first bracket and frame for releasably connecting the first bracket to the frame so that the first bracket and frame cooperatively define a U shape with a first width for straddling an upright support to maintain the article hanger in the display orientation. A second bracket is provided, with there being second structure cooperating between the second bracket and frame for releasably connecting the second bracket to the frame so that the second bracket and frame cooperatively define a U shape with a second width for straddling an upright support to maintain the article hanger in a display orientation. The first and second widths are different.

In one form, at least one of the first and second brackets is L-shaped.

The combination may farther include a third bracket, with third structure cooperating between the third bracket and frame for releasably connecting the third bracket to the frame so that the third bracket and frame cooperatively define a U shape with a third width for straddling an upright support to maintain the article hanger in the display orientation.

In one form, the frame has a cup-shape configuration defining a receptacle for an article, and the first, second and third brackets are positionable together to reside substantially fully within the frame receptacle.

One or all of the brackets could be defined by a formed wire.

The invention further contemplates the article hanger in combination with an article, that is foliage.

In one form, the first structure is at least one formed wire on the frame and at least one formed wire on the first bracket, which wires are intertwined with each other with the first bracket connected to the frame.

The invention further contemplates the article hanger in combination with an upright support.

In another form of the invention, a method is provided for forming an article hanger, which method includes the steps of: providing a frame defining a support for an article; providing a first bracket; cutting the first bracket to define first and second sub-brackets which are each connectable to the frame so that the frame and each of the first and second sub-brackets cooperatively define a U-shaped seat with a width, with the width of the seat being different with the first sub-bracket connected to the frame than with the second sub-bracket connected to the frame; connecting one of the first and second sub-brackets to the frame; providing an upright support, and directing the upright support into the U-shaped seat in the one of the first and second sub-brackets to maintain the article hanger in a display state on the upright support.

BRIEF DESCRIPTION OF THE DRAWINGS

FIG. 3 is a perspective view of an article hanger, according to the present invention, showing a modified form of bracket operatively connected to the frame and which can be placed selectively in three different positions on the frame to produce three different seat sizes;

FIG. 4 is an exploded perspective view of an article hanger, according to the present invention, showing two brackets which can be operatively connected to the frame, with one of the brackets being useable to produce two different seat sizes;

DETAILED DESCRIPTION OF THE DRAWINGS

Figure 1:
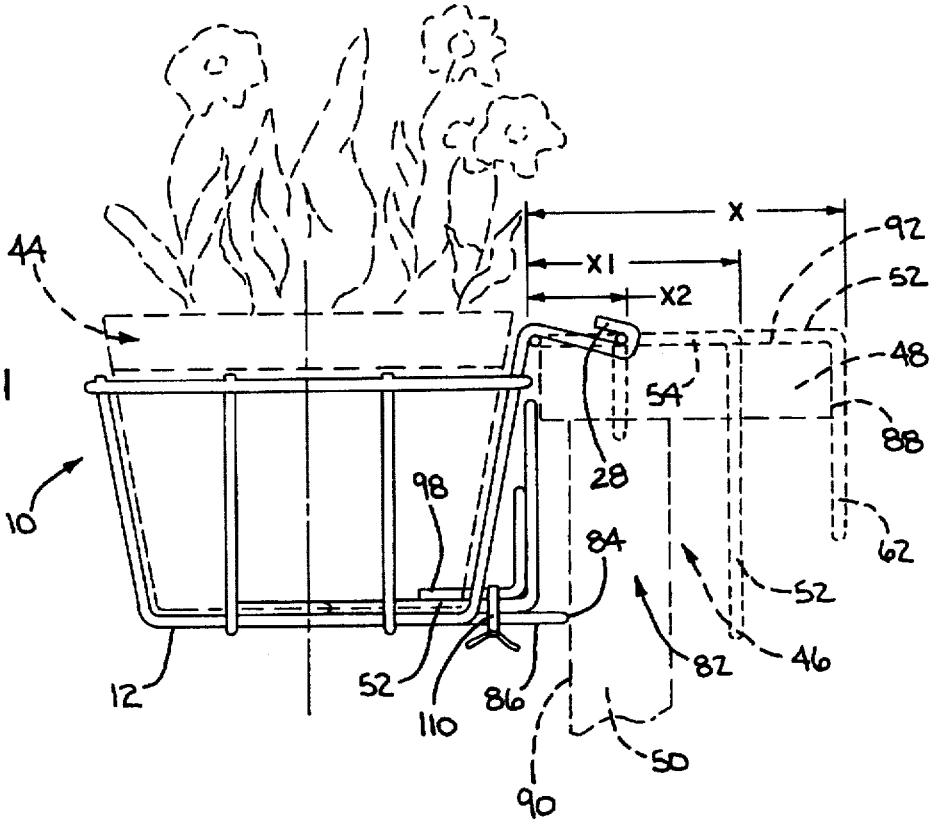
FIG. 1 is a side elevation view of an article hanger, according to the present invention, having a frame with three different brackets which are connectable to the frame and support the article hanger in a display state/orientation and with the brackets shown in a stored state in solid lines and connected to the frame in phantom lines to selectively produce three different size mounting seats for the article hanger.
Figure 2:
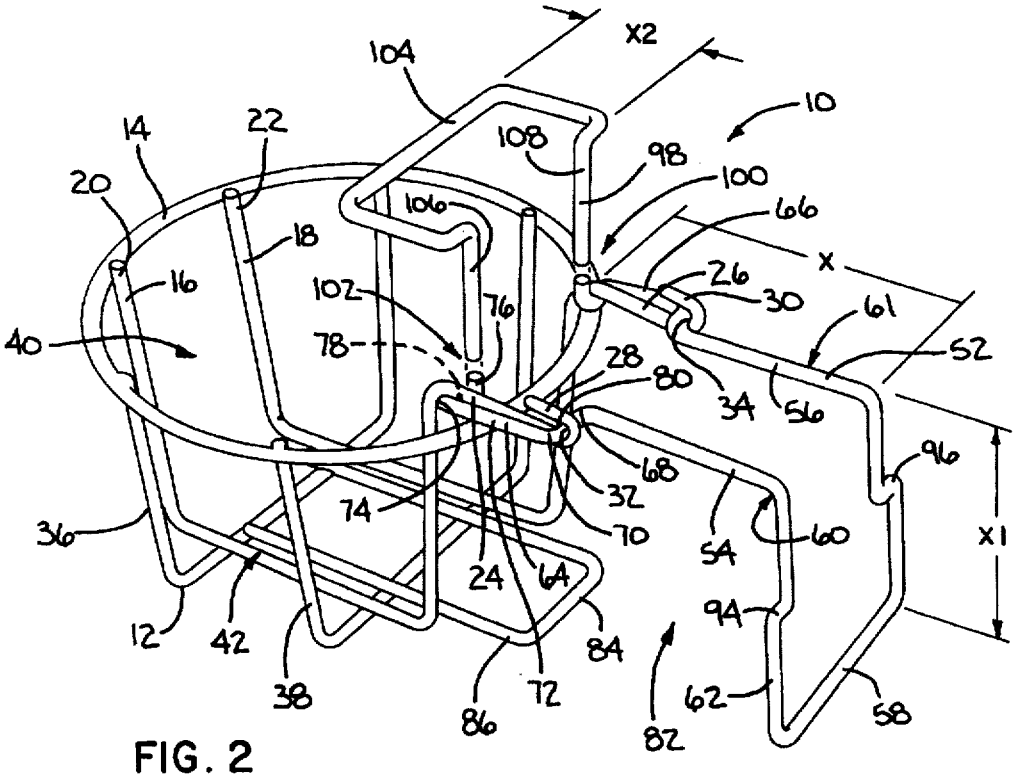
FIG. 2 is a perspective view of the article hanger of FIG. 1 with one bracket operatively connected to the frame and capable of being selectively mounted in a different manner to the frame to produce different size mounting seats, and from which a sub-bracket is cut which in turn can be operatively connected to the frame to produce a third seat size.

In FIGS. 1 and 2, one form of article hanger, according to the present invention, is shown at 10. The article hanger 10 has a frame 12 defined by formed, welded, plastic-coated, metal wire. The frame 12 includes an annular metal wire 14 to which two U-shaped metal wires 16, 18 are joined. The wires 16, 18 have free ends 20, 22 which are connected to the annular wire 14 and opposite ends 24, 26 which connect to and project over the annular wire 14 and radially outwardly therefrom, with each terminating at a return bend 28, 30 defining U-shaped, inwardly opening seats 32, 34. U-shaped wires 36, 38 extend transversely to the U-shaped wires 16, 18 and define in conjunction therewith a cup-shaped receptacle 40 with an upwardly facing support 42 for an article 44, which may be a potted plant or flower, as shown in FIG. 1. The nature of the article 44 and the precise shape of the receptacle 40 are not critical to the present invention.

The article hanger 10 is designed to be mounted on an upright support as shown at 46. The support 46 includes a horizontally extending rail 48 with an upright member 50 under the rail 48 that may be a facing board or a post. This support 46 is intended only to be exemplary of the many types of different structures upon which the article hanger 10 can be supported.

The article hanger 10 is held in the display state/orientation of FIG. 1 upon the support 46 cooperatively by the frame 12 and a bracket 52. The bracket 52 is defined by plastic-coated metal wire which is formed into the shape of a U with spaced legs 54, 56 and a base portions 58. The bracket 52 is bent at its midportion 60 at substantially a right angle to define a main horizontal section 61 and an offset section 62.

The free ends 64, 66 of the legs 54, 56 are configured to cooperate with the frame 12 to support the bracket 52 thereon so that the legs 54, 56 on the main section 61 project substantially horizontally therefrom. Since the cooperation between the each leg 54, 56 and the frame 12 is substantially the same, only representative leg 54 will be described in detail herein.

The leg 54 has spaced right angle bends 68, 70 that produce a Z shape at the midportion of the leg 54 and a straight section 72 projecting substantially parallel to the leg 54 at the main section 61. The straight section 72 extends to an additional right angle bend 74, with the free end 76 of the leg formed beyond the bend 74 to project upwardly so as to define an upwardly opening, U-shaped seat 78.

Through a simple manipulation of the bracket 52, the leg 54 can be intertwined/meshed with the frame 12 as shown in FIGS. 1 and 2 to thereby maintain the bracket 52 and frame 12 connected without the need for any separate fasteners. With the bracket 52 connected to the frame 12, the free end portion of the leg 54 wraps under and partially around the wire end 24 so that the wire end 24 nests in the seat 78. A transition section 80 between the bends 68, 70 simultaneously nests in the seat 32.

Translatory movement of the bracket 52 to the right in FIG. 2 relative to the frame 12 is limited by the abutment of the seat 32 to the transition section 80 on the leg 54.

With the bracket 52 operatively connected to the frame 12, the frame 12 and bracket 52 cooperatively define an inverted, U-shaped seat 82 to accept and straddle the support 46. The width of the U-shaped seat 82 is determined by the spacing between the offset bracket section 62 and the base 84 of a U-shaped bumper wire 86 which is attached to the wires 36, 38.

As seen in FIG. 1, with the article hanger 10 in the display orientation, the offset section 62 on the bracket 52 abuts to a surface 88 on the support 46 facing in one direction, while the base 84 of the bumper wire 86 abuts to a surface 90 on the upright member 50 that is facing oppositely to the surface 88. The legs 54, 56 span the upper surface 92 of the rail 48 and limit downward movement of the article hanger 10. This manner of mounting is the same as the straddle mount that is shown in U.S. Pat. No. 5,390,443.

One novel aspect of the invention is that the offset section 62 on the bracket 52 can be directly joined to the frame 12 so that the offset section 62 defines the base of the U-shaped seat 82 and the legs 54, 56 at the main bracket section 61 define the leg of the U-shaped seat 82 remote from the frame 12. With this alternative arrangement, the base 58 is dimensioned to span the two wire ends 24, 26 and resides under the ends 24, 26 and above the annular wire 14. The offset section 62 is formed in a T shape with transition sections 94, 96 which bear upon the seats 34, 32 and confine relative movement between the frame 12 and bracket 52 that would enlarge the width of the seat 82.

With the bracket 52 connected as in FIG. 2, the seat 82 has an effective width identified as X in FIGS. 1 and 2. With the offset section 62 connected directly to the frame 12, the U-shaped seat 82 has an effective width X1.

The invention also contemplates that the bracket 52 could be formed as a continuous closed loop including an L-shaped section 98 extending between the free ends of the legs 54, 56. It is contemplated that if this additional section 98 is provided that the bracket 52 be cut as shown at 100, 102 so that the section 98 defines a separate sub-bracket that is useable by itself in place of the bracket 52, previously described.

More particularly, the L-shaped section 98 has a rectangular body 104 with depending legs 106, 108. The body 104 can be fit to the frame 12, without fasteners, in the same manner that the offset section 62 is connected to the frame 12. With this arrangement, the rectangular body 104 is arranged to define the base of the U-shaped seat 82, with the legs 106, 108 defining the leg of the U-shaped seat 82 remote from the frame 12. By using the section 98 as a mounting bracket, the effective width of the U-shaped seat 82 is identified as X2.

In one exemplary form, the dimension X2 accommodates a nominal two inch lumber width, with X1 accommodating a nominal four inch lumber width and X accommodating a nominal six inch lumber width.

With this arrangement, a single, universal kit can be provided. A purchaser can connect the bracket 98 or alternatively connect the bracket 52 in either of two different manners to select any of three widths for the U-shaped seat 82. Connection of each of the brackets 52, 98 can be simply accomplished by relatively repositioning the frame 12 and brackets 52, 98, without the need for separate fasteners.

As an added convenience and space saving feature, the brackets 52, 98 can be nested, one within the other as shown in FIG. 1 and secured to the frame 12, as through a tie 110. As shown, the nested brackets 52, 98 can be situated so as to reside substantially entirely within the receptacle 40 defined by the frame 12.

In FIG. 3, a modified form of mounting bracket is shown at 112. The mounting bracket 112 has an overall T shape with three, separate, rectangular mounting portions 114, 116, 118, at three different locations thereon. Each mounting portion 114, 116, 118 has the same general configuration as the body 104 on the bracket 98 in FIGS. 1 and 2. The frame 12 has the same configuration as that shown in FIGS. 1 and 2. Each of the mounting portions 114, 116, 118 cooperates with the frame 12 in the same manner as the bracket 98.

By operatively connecting the mounting portion 114 to the frame 12, the mounting portion 118 depends as part of the leg bounding the U-shaped seat 82 that is remote from the frame 12. This produces a seat width X2.

By connecting the mounting portion 116 to the frame 12, the connecting portion 118 depends to define part of the leg bounding the U-shaped seat 82 that is remote from the frame 12. However, since the mounting portion 118 depends from a location closer to the mounting portion 114 than the mounting portion 116, the bracket 112 in this arrangement produces a width for the seat 82 having the dimension X1.

With the arrangement in FIG. 3, a single bracket can be supplied to produce three different widths for the seat 82.

Figure 5:
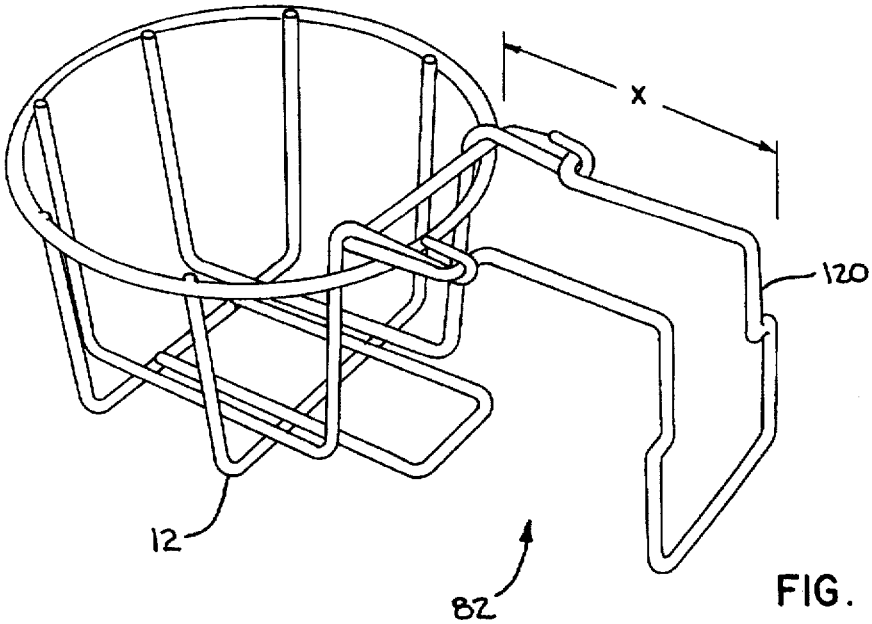
FIG. 5 is a view as in FIG. 4 with one of the brackets operatively connected to the frame.

FIGS. 4 and 5 show a bracket 120 in combination with the bracket 98, previously described. The bracket 120 is similar to the bracket 52. Instead of cutting the bracket 98 from the bracket 120, as the bracket 98 is cut from the bracket 52, the bracket 98 is separately formed. The mounting portion 122 on the bracket 120, rather than having free ends, is closed. The mounting portion 122 is shown operatively connected to the frame 12 in FIG. 5 to produce a seat 82 having an effective width X. Connection of the ,mounting portion 124 on the bracket 120 produces a seat 82 with a width X1.

Figure 6:
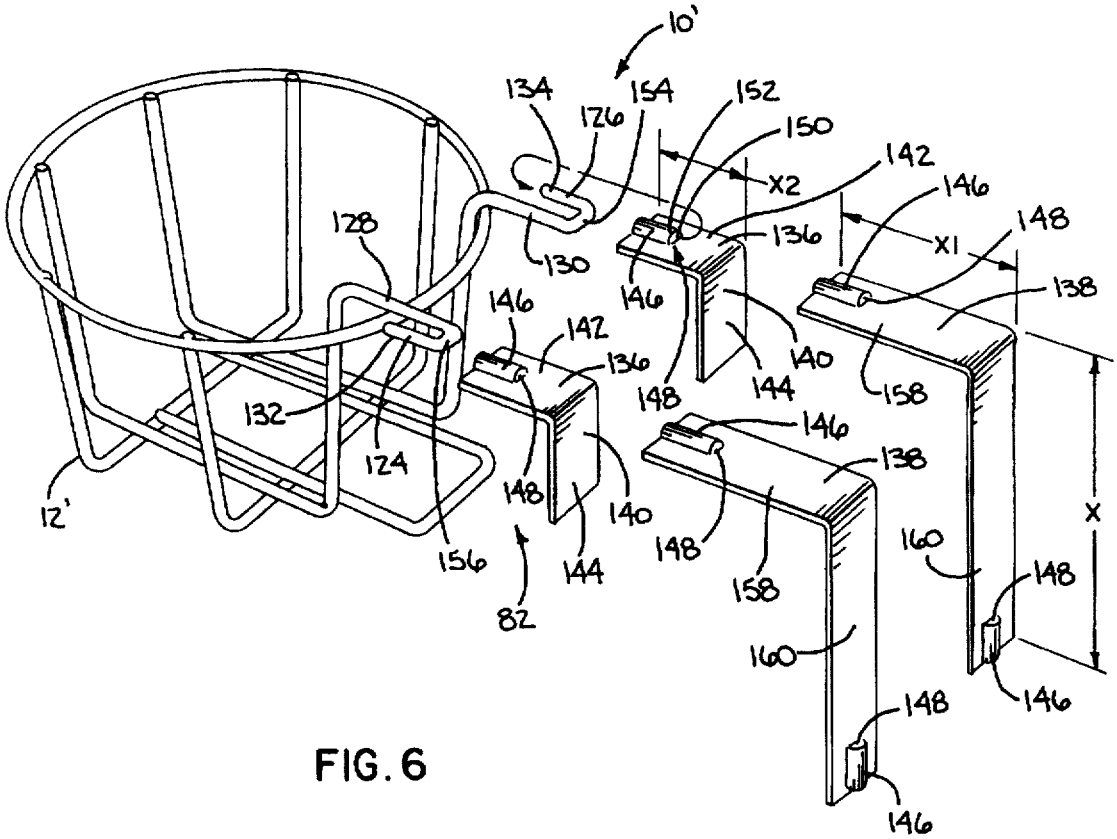
FIG. 6 is an exploded perspective view of an article hanger, according to the present invention, and showing two different pairs of mounting brackets that can be used to define two different size seats.

In FIG. 6, a modified form of article hanger is shown at 10'. The article hanger 10' has a lime 12' that is similar to the frame 12 previously described with the exception that return bends 124, 126, corresponding to the return bends 28, 30, previously described, project substantially horizontally from the free ends 128, 130, corresponding to the free ends 24, 26, as opposed to the substantially upward projection of the return bends 28, 30.

The return bends 124, 126 each define a cantilevered post 132, 134. The posts 132, 134 cooperate one each selectively with either a first type of bracket 136 or a second type of bracket 138. The first bracket 136 has an L-shaped body 140 with a horizontal leg 142 and a vertical leg 144. The body 140 is stamped out to form a curved projection 146 defining a socket 48 for reception of one of the posts 130, 132. The posts 132, 134 are directed through an entry end 150 of each socket 148. An edge 152 on the projection 146 abuts to the bight portion 154 or the bight portion 156, depending upon which post 132, 134 is utilized, to thereby prevent widening of the seat 82.

Accordingly, with the posts 132, 134 directed into the socket 148, the frame 12' and bracket 136 cooperatively define a U-shaped seat 82 with a width X2.

The bracket 138 has a short leg 158 and a long leg 160, each having a projection 146 and socket 148 at a free end thereof to cooperate with a post 132, 134 as described for the brackets 136. If the socket 148 on the short leg 158 is utilized, the U-shaped seat 82 has a width X1. If the socket 148 on the long leg 160 is utilized, the seat 82 has a width X.

Use of the brackets 136, 138 in pairs stabilizes the article hanger 10'. Further, by forming the brackets 136, 138 from flat stock material, a substantial contact area between the brackets 136, 138 and a flat support therefor is established. This adds further stability to the system.

Figure 7:
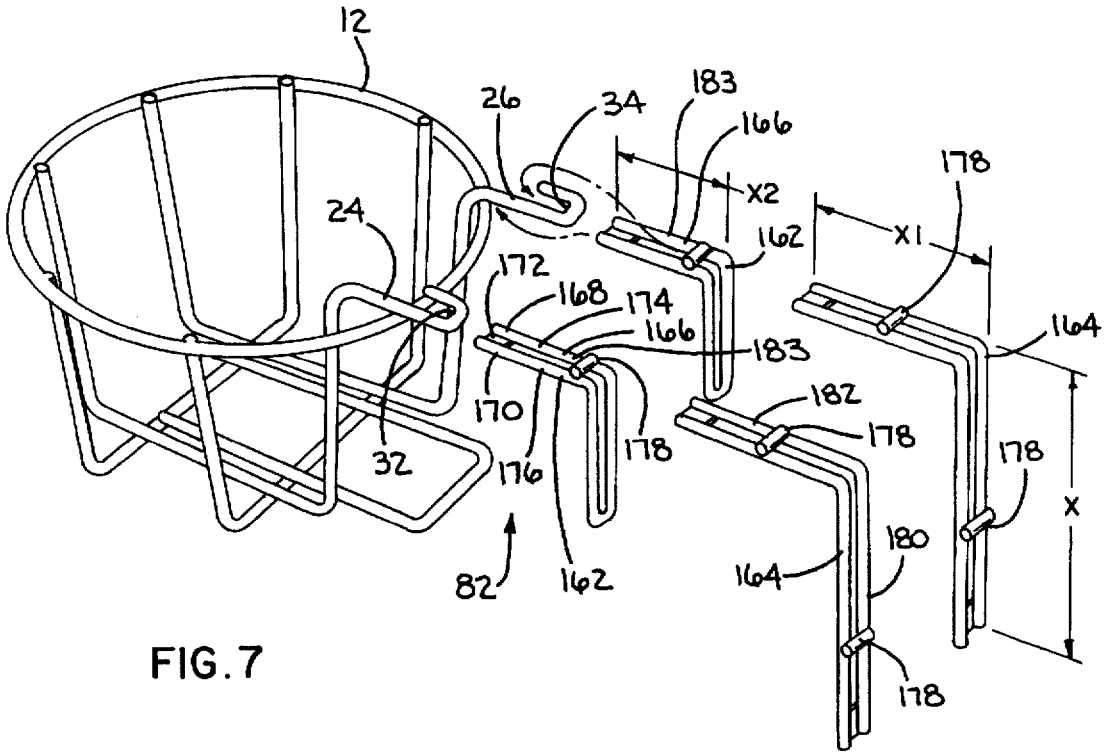
FIG. 7 is a view as in FIG. 6 with a modified form of the bracket pairs.

In FIG. 7, a variation of the system in FIG. 6 is shown. The frame 12 in FIG. 7 has the same configuration as the frame 12 previously described. Two different types of brackets 162, 164 are shown.

The first type of bracket 162 is defined by a single piece of wire 166 formed into a bent, U shape. The wire 166 has flee ends 168, 170 that are joined by a splice element 172, which maintains two straight portions 174, 176 of the wire 166 in substantially parallel, spaced relationship. A short piece of wire 178 is secured to the top of the straight wire portions 174, 176 at a location strategically spaced from the splice element 172.

To assemble the bracket 162, the straight wire portions 174, 176 are directed under the wire ends 24, 26 so that the ends 24, 26 nest in a receptacle defined by the straight wire portions 174, 176. The bracket 162 is oriented so that the wire piece 178 moves against one of the seats 32, 34.

The location of the wire piece 178 is chosen so that with the bracket 162 operatively connected to the frame 12, the width of the U-shaped seat 82 defined cooperatively by the frame 12 and bracket 162 has the dimension X2.

The brackets 164 are constructed in the same manner as the bracket 162, with the only difference being that one of the legs 180 thereon is longer than both the other leg 182 and the leg 183 on the bracket 162.

The wire pieces 178 are located to allow connection of either of the legs 180, 182 to the frame 12, as previously described. With the leg 180 connected to the frame 12, the width of the seat 82 has a dimension X. With the leg 182 connected to the frame, the seat 82 has a dimension X1.

Figure 8:
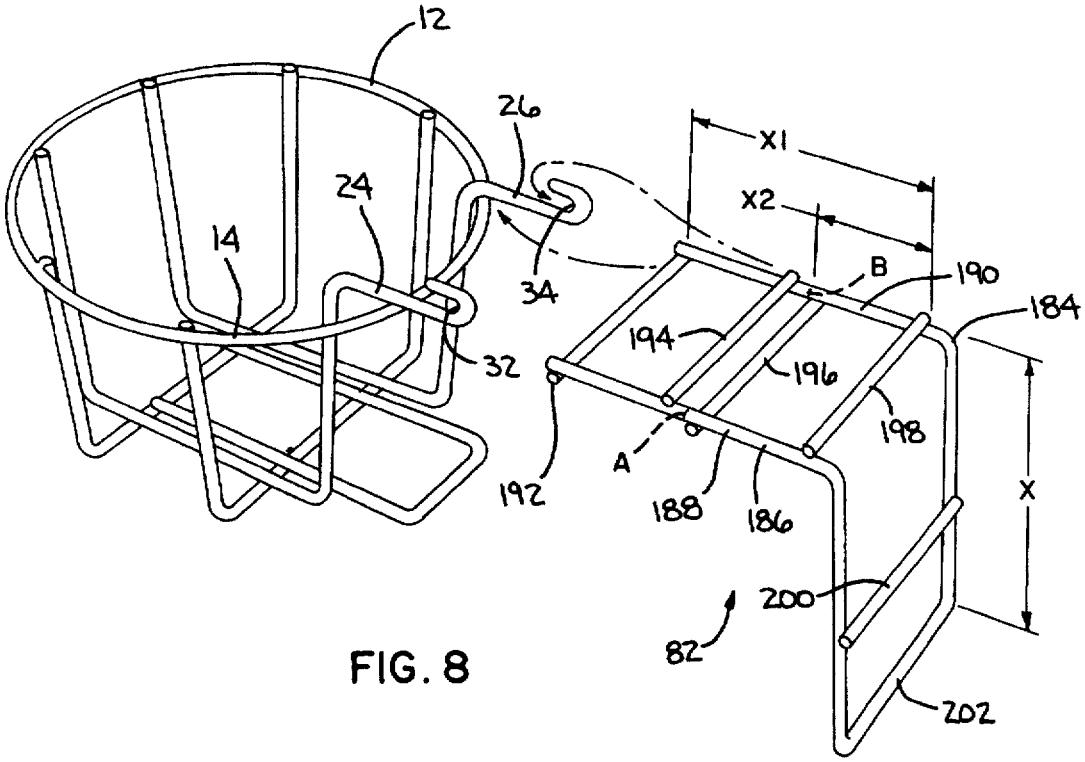
FIG. 8 is an exploded perspective view of an article hanger, according to the present invention, and showing a further modified form of bracket that can be attached to the frame in three different manners to produce three different size mounting seats.

In FIG. 8, a still further modified form of bracket is shown at 184, for use in conjunction with a frame 12, identical to the frame 12, previously described.

The bracket 184 has a wire 186 formed into a bent, U shape. The wire 186 has parallel legs 188, 190 joined by cross pieces 192, 194, 196, 198, 200.

It is intended that the bracket 184 can be connected selectively in three different manners to the frame 12. In the first manner, the cross bar 192 is directed under the wire ends 24, 26 and over the annular wire 14. The cross piece 194 then nests simultaneously in the seats 32, 34 on the frame 12. This produces a U-shaped seat 82 having a width X1.

Alternatively, the base portion 202 of the bracket 184 can be directed under the ends 24, 26 and on top of the annular wire 14 so that the cross piece 200 moves into the seats 32, 34. This produces a seat 82 having a width X.

It is contemplated that the legs 188, 190 could be severed at locations identified at A and B. By doing this, the cross piece 196 is exposed to be directed under the wire ends 24, 26 and over the annular wire 14 in such a fashion that the cross piece 198 can move into the seats 32, 34. This arrangement will produce a seat 82 having a width dimension X2.

With the invention, a two piece kit can be provided as in FIG. 3 to afford three different size capacities for the system. Alternatively, a three piece kit, as shown in FIGS. 1, 2 and 4, can be provided to afford the same versatility.

The systems in FIGS. 2 and 4 afford the convenience to the manufacturer of having to fabricate only two pieces. By cutting the brackets 52 in FIG. 2, the three size capability is afforded, while allowing convenient stacking as shown in FIG. 1.

The other embodiments show different possibilities to allow for stable mounting and size adjustment.

The foregoing disclosure of specific embodiments is intended to be illustrative of the broad concepts comprehended by the invention.

We claim:

1. An article hanger comprising:

a frame defining a support for an article, said support facing upwardly with the article hanger in a display orientation; and first means for connecting the frame to an upright support, said first means comprising a bracket and second means cooperating between the bracket and frame for selectively placing the frame and bracket in a) a first relative position wherein the frame and bracket cooperatively define a U shape with a first width for straddling an upright support to maintain the article hanger in the display orientation and b) a second relative position wherein the frame and bracket cooperatively define a U shape with a second width for straddling an upright support to maintain the article hanger in the display orientation, wherein the first and second widths are different, wherein the first means comprises means for allowing the frame and bracket to be maintained in each of the first and second relative positions without the use of separate fasteners.

2. The article hanger according to claim 1 wherein the frame has a cup-shaped configuration.

3. The article hanger according to claim 1 wherein the first means comprises means cooperating between the bracket and frame for selectively placing the frame and bracket in a third relative position wherein the frame and bracket cooperatively define a U shape with a third width for straddling an upright support to maintain the article hanger in the display orientation, said third width being different than the first and second widths.

4. The article hanger according to claim 1 wherein the bracket comprises a single formed piece of wire.

5. The article hanger according to claim 4 wherein the formed piece of wire defines a U shape having first and second legs with free ends and the first means comprises the free ends of the first and second legs which connect to the frame.

6. An article hanger comprising:

a frame defining a support for an article, said support facing upwardly with the article hanger in a display orientation; and first means for connecting the frame to an upright support, said first means comprising a bracket and second means cooperating between the bracket and frame for selectively placing the frame and bracket in a) a first relative position wherein the frame and bracket cooperatively define a U shape with a first width for straddling an upright support to maintain the article hanger in the display orientation and b) a second relative position wherein the frame and bracket cooperatively define a U shape with a second width for straddling an upright support to maintain the article hanger in the display orientation, wherein the first and second widths are different, wherein the bracket has a first portion, that upon being cut from the bracket defines a sub-bracket, there being means cooperating between the sub-bracket and frame for selectively placing the frame and sub-bracket in a relative position wherein the frame and sub-bracket cooperatively define a U shape with a third width for straddling an upright support to maintain the article hanger in the display orientation, said third width being different than both the first and second widths.

7. A method of forming an article hanger comprising the steps of:

providing a frame defining a support for an article;

providing a first bracket;

cutting the first bracket to define first and second sub-brackets which are each connectable to the flame so that the frame and each of the first and second sub-brackets define a U-shaped seat with a width, with the width of the seat being different with the first sub-bracket connected to the frame than with the second sub-bracket connected to the frame, connecting one of the first and second brackets to the frame;

providing an upright support; and directing the upright support into the U-shaped seat in the one of the first and second brackets to maintain the article hanger in a display state on the upright support.

8. An article hanger comprising:

a frame defining a support for an article, said support facing upwardly with the article hanger in a display orientation; and first means for connecting the frame to an upright support, said first means comprising a bracket and second means cooperating between the bracket and frame for selectively placing the frame and bracket in a) a first relative position wherein the frame and bracket cooperatively define a U shape with a first width for straddling an upright support to maintain the article hanger in the display orientation and b) a second relative position wherein the frame and bracket cooperatively define a U shape with a second width for straddling an upright support to maintain the article hanger in the display orientation, wherein the first and second widths are different, wherein the second means cooperating between the bracket and frame comprises a post projecting in cantilever fashion from one of the frame and bracket and a socket for receiving the post on the other of the frame and bracket.

9. An article hanger comprising:

a frame defining a support for an article, said support facing upwardly with the article hanger in a display orientation; and first means for connecting the frame to an upright support, said first means comprising a bracket and second means cooperating between the bracket and frame for selectively placing the frame and bracket in a) a first relative position wherein the frame and bracket cooperatively define a U shape with a first width for straddling an upright support to maintain the article hanger in the display orientation and b) a second relative position wherein the frame and bracket cooperatively define a U shape with a second width for straddling an upright support to maintain the article hanger in the display orientation, wherein the first and second widths are different, wherein the bracket has an L shape with first and second legs each having a length with the first and second legs having different lengths and the second means cooperating between the bracket and frame comprises a post projecting in cantilever fashion from the frame and a socket for receiving the post on each of the first and second legs and with the post received in the socket on the first leg the frame and bracket are in the first relative position and with the post received in the socket on the second leg the frame and bracket are in the second relative position.

10. In combination:

a frame defining a support for an article, said support facing upwardly with the article hanger in a display orientation;

a first bracket;

first means cooperating between the first bracket and frame for releasably connecting the first bracket to the frame so that the first bracket and frame cooperatively define a U shape with a first width for straddling an upright support to maintain the article hanger in the display orientation;

a second bracket; and second means cooperating between the second bracket and frame for releasably connecting the second bracket to the frame so that the second bracket and frame cooperatively define a U shape with a second width for straddling an upright support to maintain the article hanger in the display orientation, wherein the first and second widths are different.

11. The article hanger according to claim 10 wherein the first means comprises a post projecting in cantilever fashion from one of the frame and first bracket and a socket for receiving the post on the other of the frame and first bracket.

12. The article hanger according to claim 10 wherein at least one of the first and second brackets is L-shaped.

13. The article hanger according to claim 10 wherein the first means comprises means for connecting the first bracket to the frame without any separate fasteners.

14. The article hanger according to claim 10 in combination with a third bracket and third means cooperating between the third bracket and frame for releasably connecting the third bracket to the frame so that the third bracket and frame cooperatively define a U shape with a third width for straddling an upright support to maintain the article hanger in the display orientation.

15. The article hanger according to claim 14 wherein the frame has a cup-shaped configuration defining a receptacle for an article and the first, second, and third brackets are positionable together to reside substantially fully within the frame receptacle.

16. The article hanger according to claim 10 wherein the first and second brackets are defined by formed wire.

17. The article hanger according to claim 10 in combination with an article that is foliage.

18. The article hanger according to claim 10 wherein the first means comprises at least one formed wire on the frame and at least one formed wire on the first bracket which wires are intertwined with each other with the first bracket connected to the frame.

19. The article hanger according to claim 10 in combination with an upright support to which the article hanger is attached.

* * * * *